US009566792B2

(12) United States Patent
Inomata

(10) Patent No.: US 9,566,792 B2
(45) Date of Patent: Feb. 14, 2017

(54) FLUSHING CONTROL METHOD FOR AN INKJET PRINTER, AND AN INKJET PRINTER

(71) Applicant: Seiko Epson Corporation, Tokyo (JP)

(72) Inventor: Satoshi Inomata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/731,790

(22) Filed: Jun. 5, 2015

(65) Prior Publication Data

US 2015/0266300 A1 Sep. 24, 2015

Related U.S. Application Data

(62) Division of application No. 12/910,133, filed on Oct. 22, 2010.

(30) Foreign Application Priority Data

Oct. 29, 2009 (JP) ..... 2009-248531

(51) Int. Cl.
*B41J 2/165* (2006.01)

(52) U.S. Cl.
CPC ..... *B41J 2/16511* (2013.01); *B41J 2/1652* (2013.01); *B41J 2/16526* (2013.01)

(58) Field of Classification Search
None
See application file for complete search history.

(56) References Cited

U.S. PATENT DOCUMENTS

| | | | | |
|---|---|---|---|---|
| 5,726,692 A * | 3/1998 | Yamaguchi | B41J 2/16523 347/10 |
| 5,896,143 A | 4/1999 | Matsui et al. | |
| 6,276,778 B1 | 8/2001 | Katayama | |
| 6,299,277 B1 | 10/2001 | Fujii | |
| 6,913,339 B2 * | 7/2005 | Uchida | B41J 2/16552 347/29 |

FOREIGN PATENT DOCUMENTS

| | | |
|---|---|---|
| JP | 10-146993 A | 6/1998 |
| JP | 2000-015843 A | 1/2000 |
| JP | 2004-160792 A | 6/2004 |
| JP | 2006-159841 A | 6/2006 |

* cited by examiner

*Primary Examiner* — Alejandro Valencia
(74) *Attorney, Agent, or Firm* — Nutter McClennen & Fish LLP; John J. Penny, Jr.; Joshua I. Rudawitz

(57) ABSTRACT

An inkjet printer can appropriately flush two inkjet heads disposed to a carriage. The inkjet printer 1 flushes the first inkjet head 13A before printing starts when print data is received (step ST1), and flushes a second inkjet head 13B while the carriage 14 returns from the printing area C to the home position A after printing ends (steps ST2, ST3). As a result, because the carriage 14 is not moved from the home position A before printing starts, the start of printing is not delayed. Furthermore, because the direction of carriage 14 movement does not change after the second inkjet head 13B is flushed, the carriage 14 returns to the home position A quickly. Starting printing the next print data is therefore not delayed.

13 Claims, 9 Drawing Sheets

FLUSHING CONTROL METHOD FOR AN INKJET PRINTER, AND AN INKJET PRINTER

PRIORITY

The present application is a divisional of and claims priority under 35 U.S.C. §120 to U.S. patent application Ser. No. 12/910,133 filed on Oct. 22, 2010, which claims priority under 35 U.S.C. §119 to Japanese Application 2009-248531 filed on Oct. 29, 2009, each of which is hereby incorporated by reference in its entirety.

BACKGROUND

Technical Field

The present invention relates to a flushing control method for an inkjet printer that can appropriately flush two inkjet heads mounted on a carriage, and to an inkjet printer.

Related Art

The nozzles of an inkjet head used in an inkjet printer can become clogged as a result of an increase in the viscosity of ink left inside the nozzles, resulting in the clogged nozzles being unable to discharge sufficient ink. If printing is attempted using an inkjet head in which some nozzles are clogged, dots may be dropped or ill-formed and print quality drops accordingly. Inkjet printers therefore regularly or at specified times move the carriage that carries the inkjet head to a home position removed from the printing area so that a head cap with an ink sponge used for maintenance is opposite the nozzle surface of the inkjet head, and then discharge a specific amount of ink from each of the nozzles to flush the nozzles.

An inkjet printer that flushes the nozzles is taught, for example, in Japanese Unexamined Patent Appl. Pub. JP-A-H10-146993. The inkjet printer taught in JP-A-H10-146993 counts the time that the maintenance head cap caps the inkjet head while the carriage is stopped in the home position, and flushes the nozzles regularly based on this time.

When the inkjet head has first and second inkjet heads, a carriage on which the first and second inkjet heads are mounted adjacent to each other in the carriage scanning direction, and a carriage drive mechanism that drives the carriage bidirectionally in the carriage scanning direction, two maintenance head caps could conceivably be provided for maintenance of these two inkjet heads. However, because an ink sponge and suction mechanism for suctioning ink from the nozzles are generally disposed in the maintenance head cap, two suction mechanisms are needed if two maintenance head caps are provided, and construction becomes complicated.

A single maintenance head cap could be disposed to a maintenance position that is opposite the first inkjet head when the carriage moves to the home position and the first inkjet head is closer to the printing area than the second inkjet head. When the nozzles are flushed, the carriage could then be moved in the scanning direction so that each inkjet head is sequentially set to the maintenance position and the nozzles are flushed one inkjet head at a time.

However, in order to flush the second inkjet head, which is positioned on the side separated from the printing area when the carriage is set to the maintenance position as described above, the carriage must move from the home position to the printing area side, causing the first inkjet head to protrude into the printing area side. As a result, if the second inkjet head is flushed before printing starts, printing cannot start unless the carriage is returned to the home position after flushing is completed, and the start of printing is thus delayed. In addition, if the second print head is not flushed in order to avoid delaying the start of printing, dropped dots and other problems can result in a loss of print quality.

SUMMARY

An inkjet printer and a flushing control method for an inkjet printer according to the present invention enable flushing two inkjet heads mounted on a carriage without delaying the start of printing.

A first aspect of the invention is a flushing control method for an inkjet printer that moves adjacently disposed first and second inkjet heads bidirectionally through a printing area and prints on a recording medium passing through the printing area, and after printing ends moves the first and second inkjet heads to a home position removed from the printing area and positions the first inkjet head on the printing area side to a flushing position opposite a flushing head cap containing an ink sponge, the flushing control method including steps of: flushing the first inkjet head at the flushing position before the first and second inkjet heads move from the home position to the printing area side when printing starts; and flushing the second inkjet head when the second inkjet head is at the flushing position when the first and second inkjet heads move from the printing area to the home position after printing ends.

This aspect of the invention flushes the first inkjet head while it is positioned at the flushing position opposite the flushing head cap at the home position before printing starts. As a result, starting printing is not delayed because moving the carriage from the home position before printing starts is not necessary.

In addition, because the second inkjet head is flushed after printing ends, discharge problems in the second inkjet head caused by increased viscosity in the ink remaining inside the nozzles can be reduced or avoided.

Yet further, because the second inkjet head is flushed while the carriage returns to the home position, changing the direction of carriage movement after the second inkjet head is flushed is not necessary. As a result, because the carriage can return quickly to the home position, starting printing the next print job is not delayed.

In another aspect of the invention, flushing the second inkjet head is done when the second inkjet head is temporarily stopped. If flushing is done while the carriage is stopped, the ink can be easily discharged into the flushing head cap.

In another aspect of the invention, flushing the second inkjet head is done while the second inkjet head is moving. Because this aspect of the invention returns the carriage to the home position without delay, starting the next print job is not delayed.

Further preferably, the flushing control method according to another aspect of the invention also caps the second inkjet head with a moisture retention head cap, counts the time elapsed since the last flushing of the second inkjet head, and determines if the elapsed time has reached a predetermined reference time while the first and second inkjet heads are stopped at the home position A. When the elapsed time reaches the reference time, the first and second inkjet heads are moved from the home position toward the printing area, the second inkjet head is stopped at the flushing position, and then the second inkjet head is flushed.

When the carriage remains stopped at the home position for a long time, this aspect of the invention flushes the second inkjet head before the viscosity of ink remaining in the second inkjet head increases. Therefore, discharge problems caused by increased ink viscosity in the nozzles of the second inkjet head when printing starts the next time can be avoided.

Another aspect of the invention is an inkjet printer that has: first and second inkjet heads; a carriage on which the first and second inkjet heads are adjacently disposed; a carriage drive mechanism that moves the carriage bidirectionally through a printing area; a flushing head cap that has an ink sponge; a print control means that moves the carriage bidirectionally and prints on a recording medium passing the printing area by means of the first and second inkjet heads, moves the carriage to a home position removed from the printing area after printing ends, and positions the first inkjet head on the printing area side to a flushing position opposite the flushing head cap; a first flushing control means that flushes the first inkjet head at the flushing position before moving the carriage from the home position to the printing area when printing starts; and a second flushing control means that when the carriage moves from the printing area to the home position after printing ends, flushes the second inkjet head when the second inkjet head is at the flushing position.

With this aspect of the invention, the first flushing control means flushes the first inkjet head positioned at the flushing position opposite the flushing head cap in the home position before printing starts. As a result, the start of the printing operation is not delayed because moving the carriage from the home position before printing starts is not necessary.

In addition, because the second flushing control means flushes the second inkjet head after printing ends, discharge problems in the second inkjet head caused by increased viscosity in the ink remaining inside the nozzles can be reduced or avoided.

Yet further, because the second flushing control means flushes the second inkjet head while the carriage returns to the home position, changing the direction of carriage movement after the second inkjet head is flushed is not necessary. As a result, because the carriage can return quickly to the home position, starting printing the next print job is not delayed.

Further preferably, the second flushing control means flushes the second inkjet head when the carriage is temporarily stopped. If flushing is done while the carriage is stopped, the ink can be easily discharged into the flushing head cap.

In another aspect of the invention the second flushing control means flushes the second inkjet head while moving the carriage. Because the carriage returns to the home position without delay in this aspect of the invention, starting the next print job is not delayed.

Further preferably in another aspect of the invention, the inkjet printer also has a moisture retention head cap that can cap the second inkjet head; an elapsed time monitoring means that counts the time elapsed since the last flushing of the second inkjet head while the carriage is stopped at the home position, and monitors whether or not the elapsed time has reached a predetermined reference time; and a third flushing control means that, when the elapsed time reaches the reference time, moves the carriage from the home position toward the printing area, stops the second inkjet head at the flushing position, and then flushes the second inkjet head. The print control means caps the second inkjet head with the moisture retention head cap while the carriage is stopped at the home position.

With this aspect of the invention, the third flushing control means flushes the second inkjet head before ink in the second inkjet head increases in viscosity when, for example, the carriage is stopped at the home position for a long time. As a result, when printing starts next, clogged nozzles caused by increased ink viscosity in the second inkjet head can be avoided.

Effect of the Invention

When printing starts, the invention flushes a first inkjet head that is positioned at a flushing position opposite the flushing head cap when in the home position. As a result, the start of printing is not delayed because there is no need to move the carriage from the home position before printing starts. In addition, because the second inkjet head is flushed after printing ends, discharge problems caused by increased viscosity in the ink remaining inside the nozzles of the second inkjet head can also be reduced or avoided. In addition, because the second inkjet head is flushed while the carriage returns to the home position, changing the direction of carriage movement is not necessary after flushing the second inkjet head. As a result, the start of the next printing operation is not delayed because the carriage returns to the home position quickly.

Other objects and attainments together with a fuller understanding of the invention will become apparent and appreciated by referring to the following description and claims taken in conjunction with the accompanying drawings.

DESCRIPTION OF EMBODIMENTS

An inkjet printer according to a preferred embodiment of the invention is described below with reference to the accompanying figures.

General Configuration of an Inkjet Printer

Figure 1:
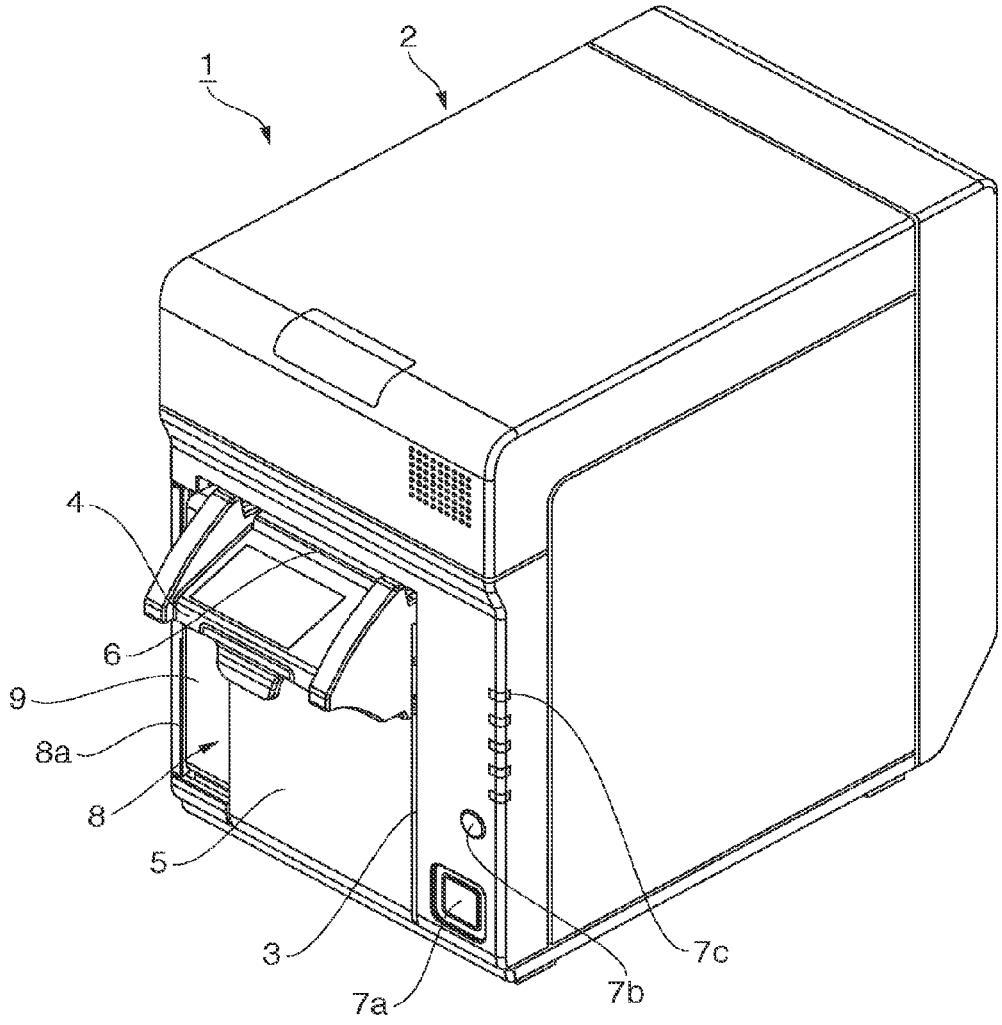
FIG. 1 is an external oblique view of an inkjet printer according to the invention.

FIG. 1 is an external oblique view of an inkjet printer. The inkjet printer 1 prints in color on a continuous web of recording paper delivered from a paper roll using plural different colors of ink, and has a generally box-shaped printer case 2 with an opening 3 for loading roll paper formed in the front center part of the printer case 2. The opening 3 is closed by an access cover 5 to which a recording paper discharge guide 4 is disposed at the top. A recording paper exit 6 is formed between the recording paper discharge guide 4 and the top edge part of the opening 3 in the printer case 2. When a lock mechanism not shown is released and the recording paper discharge guide 4 is pulled forward by hand, the access cover 5 can pivot forward at the bottom end thereof from the closed position shown in the figure to an open position.

A power switch 7*a*, paper feed switch 7*b*, and a plurality of operating status indicators 7*c* are arrayed at the right side of the access cover 5 at the front of the printer case 2. A loading opening 8*a* for an ink cartridge loading unit 8 that is rectangular in section and is disposed with the long side extending in the front-back direction of the printer is formed in the front of the printer case 2 on the left side of the access cover 5, and an ink cartridge 9 is loaded in this ink cartridge loading unit 8. When a button not shown is operated, the lock is released, the ink cartridge 9 is pushed forward by the force of a spring, and the ink cartridge 9 can be removed.

Figure 2:
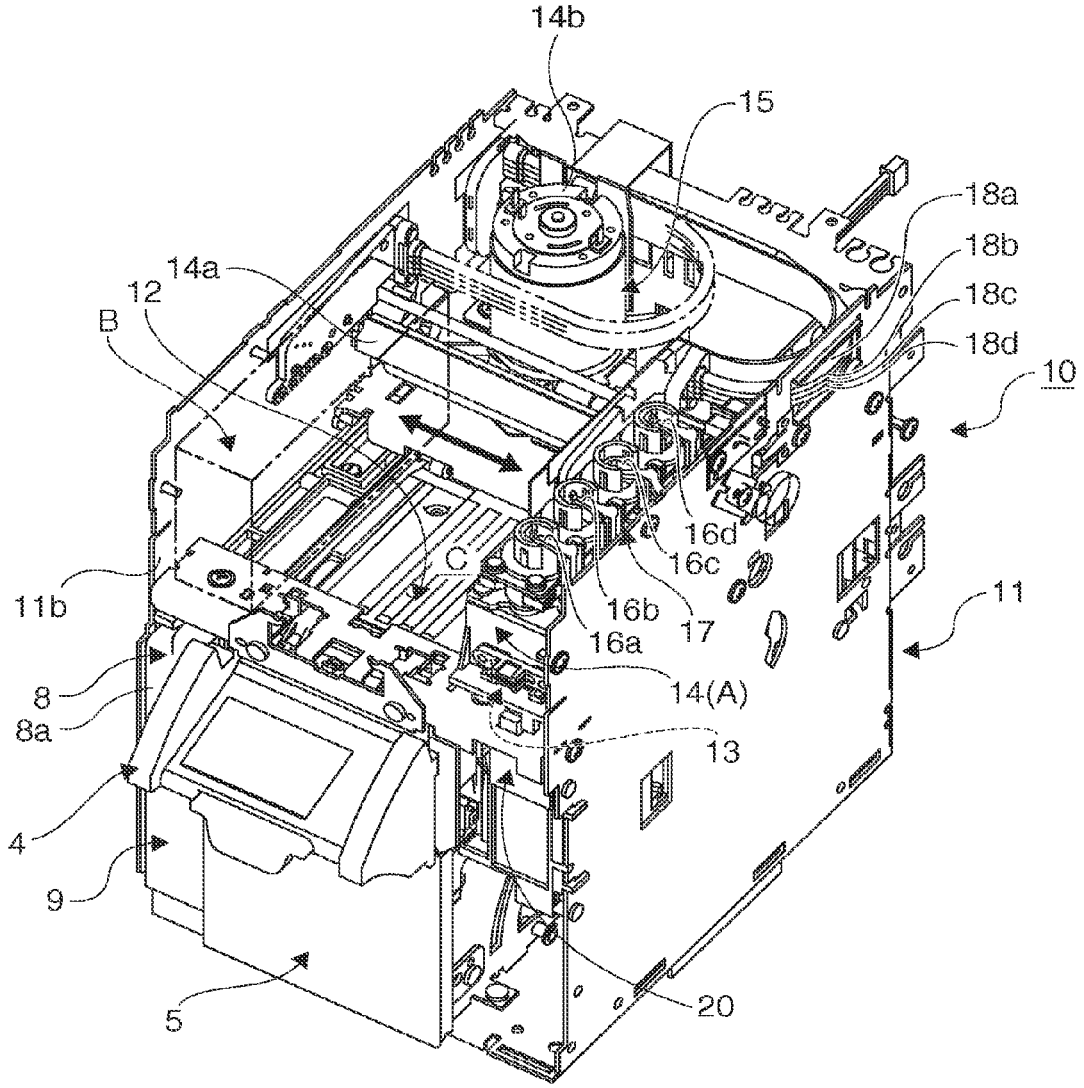
FIG. 2 is a schematic oblique view of the printer mechanism.
Figure 3:
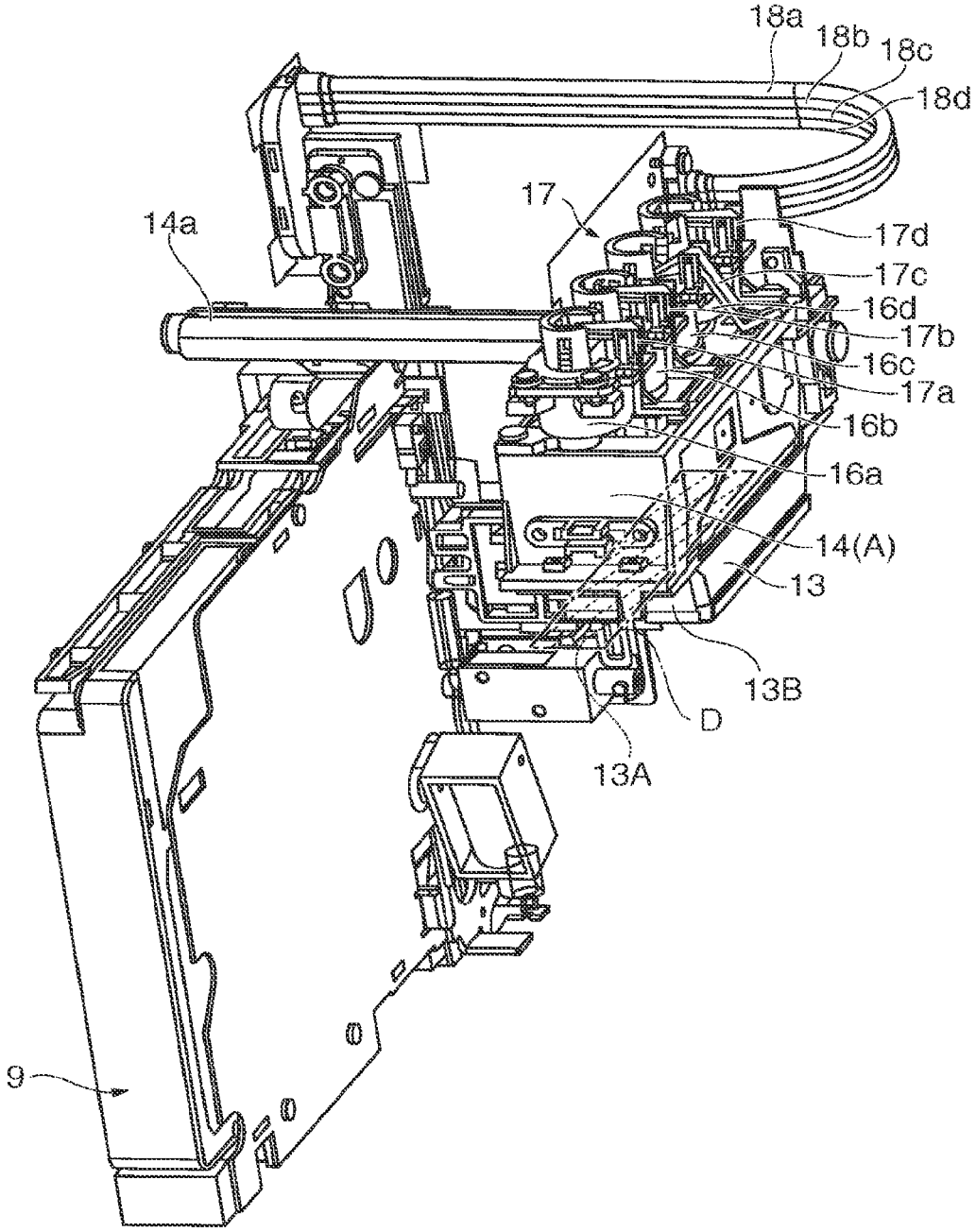
FIG. 3 schematically describes the ink supply path of the inkjet printer.

FIG. 2 is an oblique view of the print mechanism unit that is covered by the inkjet printer case. FIG. 3 schematically describes the configuration of the ink supply system of the inkjet printer.

As shown in FIG. 2, a roll paper storage compartment is formed inside the print mechanism unit 10 in the center, and when the access cover 5 opens, this roll paper storage compartment opens to the front and the roll paper can be replaced, for example. A platen 12 that determines the printing area C extends widthwise to the printer above the roll paper storage compartment.

A carriage 14 on which an inkjet head 13 is mounted with the nozzle surface facing down is disposed above the platen 12. A carriage guide shaft 14*a* extends parallel to the platen 12 widthwise to the printer behind the carriage 14, and a carriage motor 14*b* is located behind the carriage guide shaft 14*a*. The carriage motor 14*b* is the drive power source of the carriage drive mechanism 15, which moves the carriage 14 bidirectionally in the carriage scanning direction along the carriage guide shaft. The carriage 14 is moved bidirectionally between a home position A (the position indicated by a solid line in FIG. 2 and the position in FIG. 3) that is removed to the right from the printing area by the carriage drive mechanism 15, and a left end position B (the position indicated by the imaginary line in FIG. 2) removed to the left side of the platen 12.

As shown in FIG. 3, the inkjet head 13 has a pair of inkjet heads, that is, first inkjet head 13A and second inkjet head 13B, which are mounted on the carriage 14 at adjacent positions in the carriage scanning direction. When the carriage 14 is in the home position A, the first inkjet head 13A is positioned in the printing area C defined by the platen 12, and the second inkjet head 13B is positioned on the left side of the printer width separated from the printing area C.

The area that is opposite the nozzle surface 13*a* of the first inkjet head 13A with a narrow gap therebetween when the carriage 14 is in the home position A is the flushing area D. (The position of the first inkjet head at this time is the flushing position.) The vacuum head cap (flushing head cap) 22 of the head maintenance unit 20 described below is positioned at this flushing area D, and the first inkjet head 13A and second inkjet head 13B are flushed in this flushing area D.

A diaphragm pump unit 17 is disposed to the carriage 14. The diaphragm pump unit 17 has subtanks 16*a* to 16*d* in which four colors of ink, cyan, magenta, yellow, and black, are stored.

As shown in FIG. 3, the diaphragm pump unit 17 has suction levers 17*a* to 17*d* attached to the top part of the subtanks 16*a* to 16*d* so that the levers can rock. One end of each suction lever 17*a* to 17*d* is disposed on the home position side of the diaphragm pump unit 17, and the other end is linked by a spring to the diaphragm of each subtank 16*a* to 16*d*. When the carriage 14 returns to the home position A, one end of each suction lever 17*a* to 17*d* is pushed by the inside wall of the printer case 2, causing the suction lever 17*a* to 17*d* to rock, thereby operating the diaphragm connected to the other end of the suction lever 17*a* to 17*d* and producing negative pressure in the subtanks 16*a* to 16*d*. Ink is pulled from the flexible ink tube 18*a* to 18*d* side into each subtank by this negative pressure. The ink stored in each subtank 16*a* to 16*d* is supplied to the ink paths inside the first and second inkjet heads 13A and 13B.

One end of each flexible ink tube 18*a* to 18*d* is connected to a corresponding subtank 16*a* to 16*d*, and the other end of each flexible ink tube 18*a* to 18*d* is connected to one of the four ink supply paths (not shown in the figure) that extend vertically at a position on the back side of the ink cartridge loading unit 8. The ink supply paths communicate with a corresponding ink cartridge 9 loaded in the ink cartridge loading unit 8.

When print data is received, the inkjet printer 1 advances the recording paper delivered from a paper roll by a recording paper transportation mechanism not shown over the surface of the platen 12 while the carriage 14 scans bidirectionally timed to transportation of the recording paper and ink is discharged from the inkjet head 13 onto the recording paper to print on the recording paper.

Head Maintenance Unit

Figure 4:
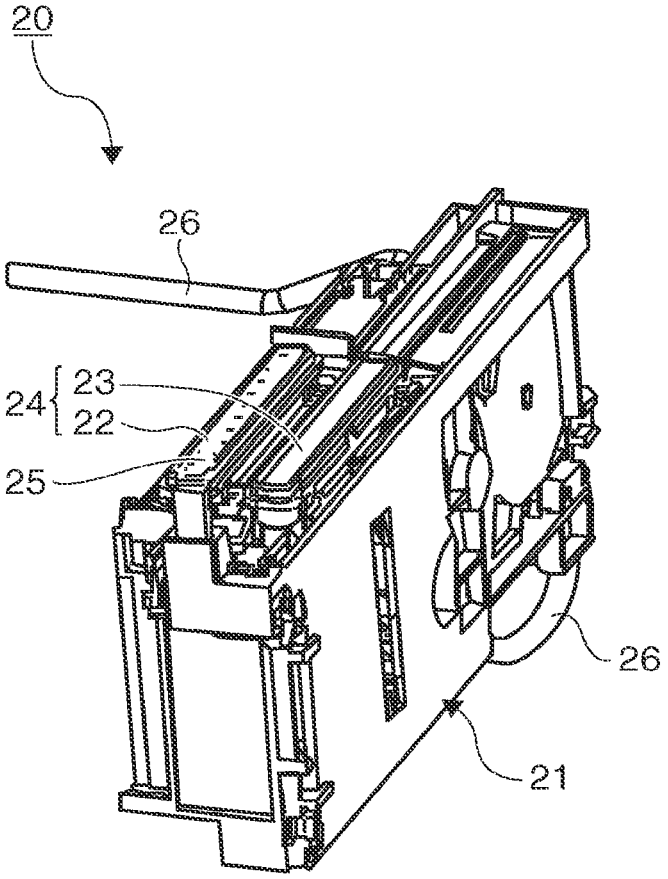
FIG. 4 is an oblique view of the head maintenance unit.

A head maintenance unit 20 is disposed at a position below the home position A. FIG. 4 is an oblique view of the head maintenance unit. The head maintenance unit 20 has a unit case 21 with a narrow rectangular shape that is long in the front-back direction of the printer. A head cap unit 24 including the vacuum head cap 22 (flushing head cap) and a moisture retention head cap 23 is disposed at the front top part of this unit case 21.

The vacuum head cap 22 and moisture retention head cap 23 are disposed adjacently widthwise to the printer, that is, in the scanning direction of the carriage 14, and are open to the top. When the carriage 14 is in the home position A, the vacuum head cap 22 is located below the first inkjet head 13A and the moisture retention head cap 23 is located below the second inkjet head 13B. A head cap lift mechanism not shown that raises and lowers the head caps in unison is assembled below the head cap unit 24. A tube pump and a tube pump drive motor not shown are assembled at a position at the back of the unit case 21.

The vacuum head cap 22 is configured so that the flushing area D is positioned inside the vacuum head cap 22, and has an ink sponge 25 disposed inside. The vacuum head cap 22 can thus absorb ink that is flushed in the flushing area D.

A tube pump and a waste ink tube 26 are connected to the vacuum head cap 22. Therefore, after moving the first inkjet head 13A or second inkjet head 13B to a position opposite the vacuum head cap 22 by driving the carriage 14, the vacuum head cap 22 is raised by the head cap lift mechanism to cap the first inkjet head 13A or second inkjet head 13B. If the tube pump is then driven, the capped first inkjet head 13A or second inkjet head 13B can be cleaned by suctioning ink therefrom.

The moisture retention head cap 23 does not have an ink sponge 25 inside, and a tube pump and waste ink tube 26 are not connected thereto. By raising the vacuum head cap 22 by means of the head cap lift mechanism when the carriage 14 is in the home position A, the nozzle surface 13*b* of the second inkjet head 13B can be sealed so that the ink does not dry.

Control System

Figure 5:
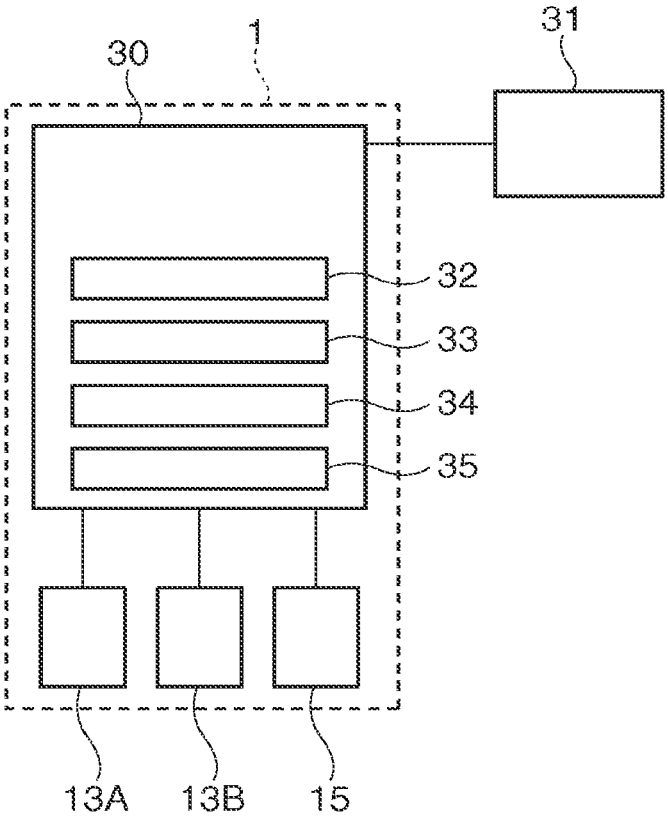
FIG. 5 is a block diagram showing the control system of the inkjet printer.

FIG. 5 is a block diagram showing the control system of the inkjet printer. The control system of the inkjet printer 1 is built around a control unit 30 that includes a CPU, ROM, and RAM. The control unit 30 is connected to a host device 31, for example, and controls other parts of the inkjet printer 1 based on print data and commands received from the host device 31.

Based on the received print data, the control unit 30 (printing control means) conveys the recording paper delivered from a paper roll over the surface of the platen 12, and discharges ink from the inkjet heads 13A, 13B while driving the carriage drive mechanism 15 so that the carriage 14 scans the paper as the paper is fed to print on the recording paper. When printing ends, the control unit 30 moves the carriage 14 to the home position A so that the nozzle surface 13*a* waits at a position opposite the vacuum head cap 22. So that the first inkjet head 13A and second inkjet head 13B do not dry while waiting the carriage 14 waits at the home position A, the control unit 30 caps the first inkjet head 13A and the second inkjet head 13B with the vacuum head cap 22 and moisture retention head cap 23, respectively.

The control unit 30 includes a first flushing control unit 32 and a second flushing control unit 33. When print data is received, the first flushing control unit 32 flushes the first inkjet head 13A opposite the vacuum head cap 22 before starting to print the print data. When printing the print data is completed and the carriage 14 returns from the printing area C to the home position A, the second flushing control unit 33 flushes the second inkjet head 13B when the second inkjet head 13B is opposite the vacuum head cap 22.

The control unit 30 also has an elapsed time monitoring unit 34 and a third flushing control unit 35.

While the carriage 14 is stopped at the home position A, the elapsed time monitoring unit 34 counts how much time has passed since the second inkjet head 13B was last flushed, and determines if this elapsed time exceeds a predetermined reference time.

If the elapsed time exceeds this predetermined reference time, the third flushing control unit 35 moves the carriage 14 from the home position A to the printing area C side, stops the carriage 14 with the second inkjet head 13B positioned opposite the vacuum head cap 22, and then flushes the second inkjet head 13B.

Flushing Operation

Figure 6:
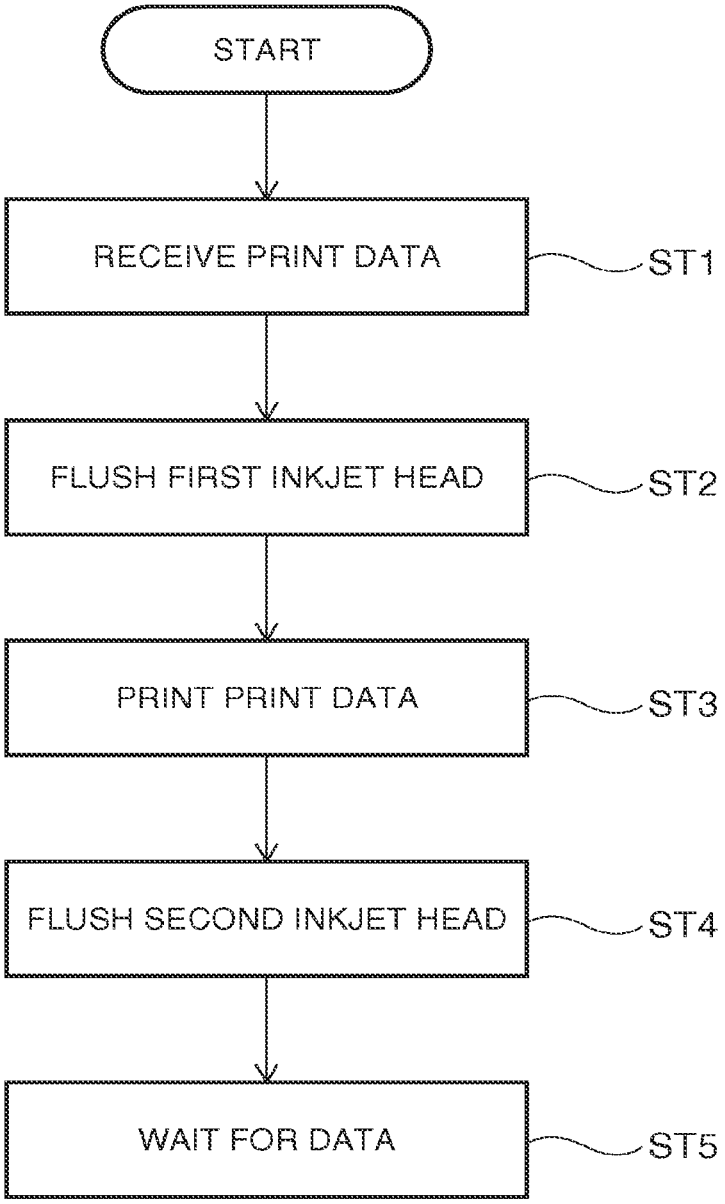
FIG. 6 is a flow chart describing the inkjet head flushing operation.

FIG. 6 is a flow chart describing the flushing operation of the first inkjet head and second inkjet head executed when print data is received. FIGS. 7A-7D describe the operating positions of the inkjet heads, the vacuum head cap, and the moisture retention head cap as seen from the front of the printer during the flushing operation described in FIG. 6.

As shown in FIG. 6, the first inkjet head 13A and second inkjet head 13B are flushed as a result of receiving print data.

Figure 7A:
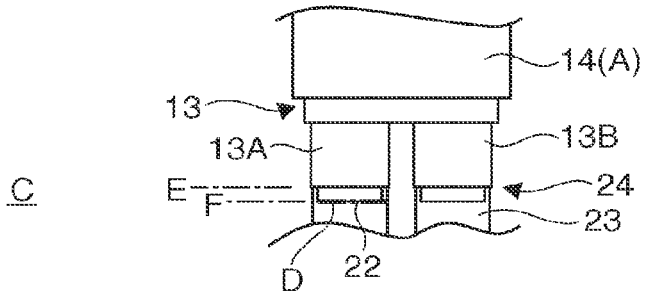
FIGS. 7A-7D describe the operating positions of the inkjet head, the inkjet head suction cap, and the head moisture retention cap during the flushing operation shown in FIG. 6.

While waiting to receive print data, the carriage 14 is in the home position A as shown in FIG. 7A. When the carriage 14 is in the home position A, the vacuum head cap 22 and moisture retention head cap 23 are raised to the capping position E by the head cap lift mechanism, and respectively cap the first inkjet head 13A and second inkjet head 13B.

Figure 7B:
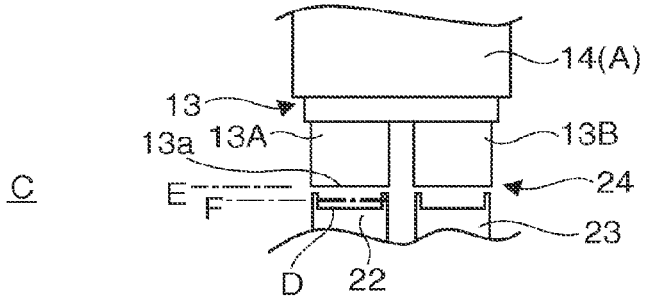

When print data is received (step ST1), the first flushing control unit 32 lowers the vacuum head cap 22 by means of the head cap lift mechanism as shown in FIG. 7B to a retracted position F where there is no interference with the first inkjet head 13A and second inkjet head 13B, and forms a small gap between the nozzle surface 13*a* of the first inkjet head 13A and the vacuum head cap 22. The first inkjet head 13A is then flushed with the carriage 14 stopped at the home position A (step ST2).

Figure 7C:
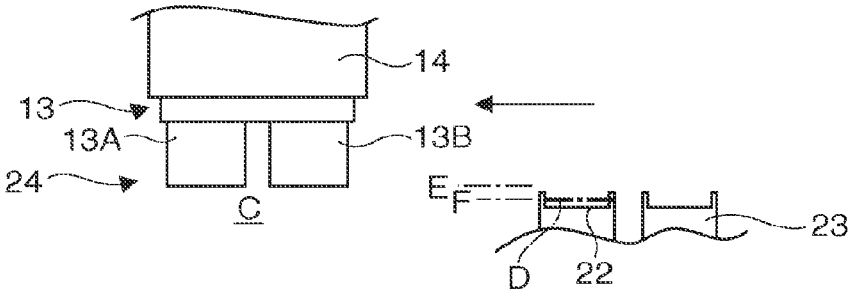

The print data is then printed (step ST3). More specifically, as shown in FIG. 7C, the control unit 30 conveys the recording paper over the surface of the platen 12 while discharging ink from the inkjet heads 13A and 13B toward the recording paper as the carriage 14 scans the printing area C in conjunction with recording paper transportation based on the received print data, and thus prints on the recording paper.

Figure 7D:
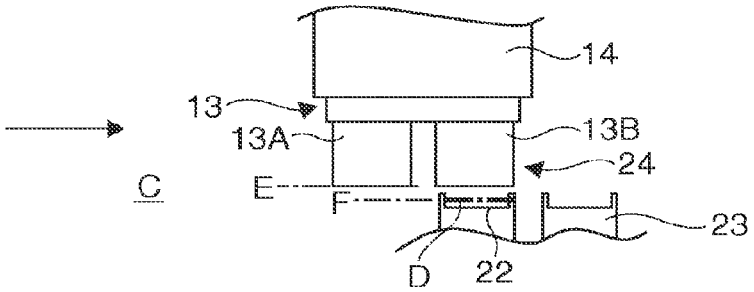

When printing the print data ends, the second flushing control unit 33 temporarily stops the carriage 14 while the carriage 14 moves from the printing area C to the home position A so that the second inkjet head 13B is opposite the vacuum head cap 22 as shown in FIG. 7D. The second inkjet head 13B is then flushed (step ST4). When flushing ends, the second flushing control unit 33 cancels pausing the carriage 14 and the carriage 14 returns to the home position A. The printer then waits to receive print data again as shown in FIG. 7A (step ST5).

With the flushing operation described above, the first inkjet head 13A is flushed while opposite the vacuum head cap 22 at the home position A before printing the print data starts. As a result, because moving the carriage 14 from the home position A is not necessary before printing the print data starts, starting printing the print data is not delayed.

Furthermore, because the second inkjet head 13B is flushed after printing the print data ends, ink discharge problems caused by an increase in the viscosity of ink inside the nozzles can also be avoided in the second inkjet head 13B.

In addition, because the second inkjet head 13B is flushed while the carriage 14 returns to the home position A, changing the direction of carriage 14 movement is not necessary after flushing the second inkjet head 13B. As a result, starting printing the next print data is not delayed because the carriage 14 returns quickly to the home position A.

Figure 8:
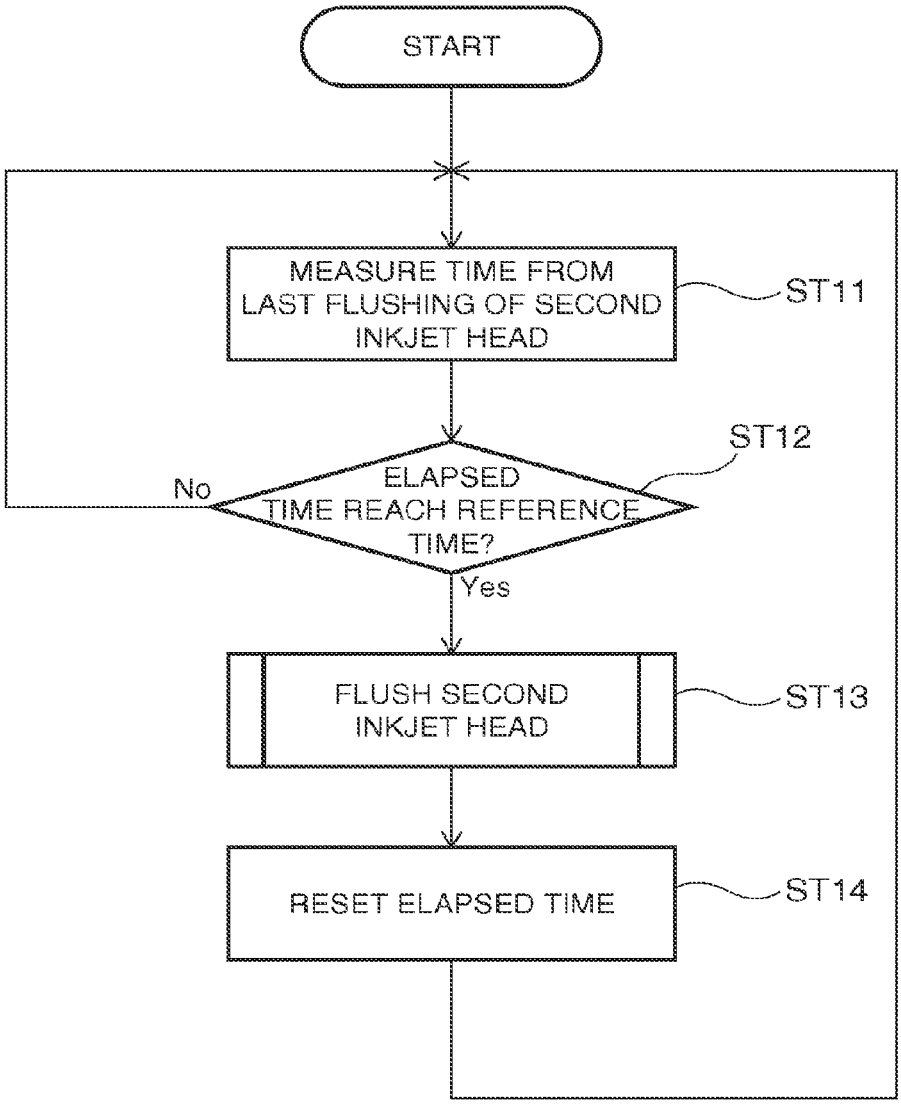
FIG. 8 is a flow chart describing the flushing operation of the second inkjet head.

In addition to the flushing operation described above, the second inkjet head 13B is also flushed based on how much time has passed since the last time the second inkjet head 13B was flushed. FIG. 8 is a flow chart describing the flushing operation of the second inkjet head based on the time passed since the last time the inkjet head was flushed. FIGS. 9A-9D describe the operating positions of the inkjet heads, the vacuum head cap, and the moisture retention head cap as seen from the front of the printer during the flushing operation described in FIG. 8.

Figure 9A:
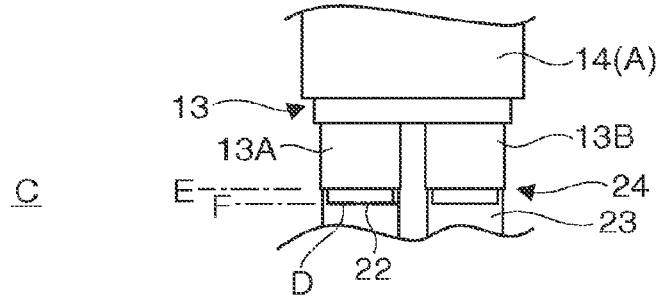
FIGS. 9A-9D describe the operating positions of the inkjet head, the inkjet head suction cap, and the head moisture retention cap during the flushing operation shown in FIG. 8.

The second inkjet head 13B is initially flushed when printing the print data is finished, for example, and the carriage 14 has returned to the home position A. When the carriage 14 is at the home position A, the vacuum head cap 22 and moisture retention head cap 23 are at the capping position E as shown in FIG. 9A where the first inkjet head 13A and second inkjet head 13B are capped so the ink does not dry.

While the carriage 14 is stopped at the home position A, the elapsed time monitoring unit 34 counts the time elapsed since the second inkjet head 13B was flushed, and determines if this elapsed time exceeds a predetermined reference time (step ST11, step ST12). This time elapsed since the last flushing may be the time elapsed with the second inkjet head 13B capped and sealed by the moisture retention head cap 23.

Figure 9B:
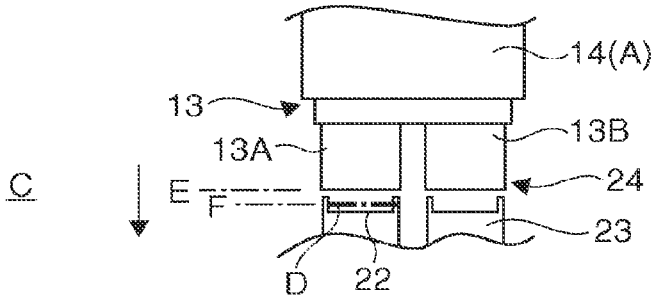

When the elapsed time exceeds the reference time, the third flushing control unit 35 lowers and retracts the vacuum head cap 22 by means of the head cap lift mechanism to the retracted position F where there is no interference with the first inkjet head 13A and second inkjet head 13B as shown in FIG. 9B.

Figure 9C:
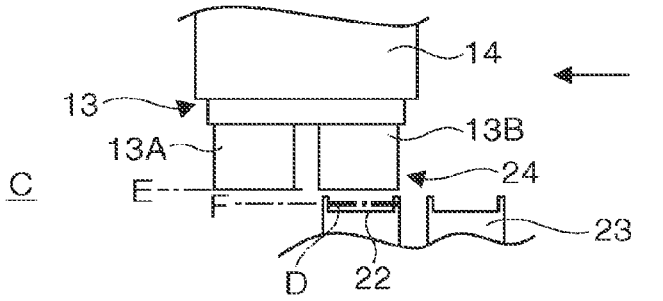
Figure 9D:
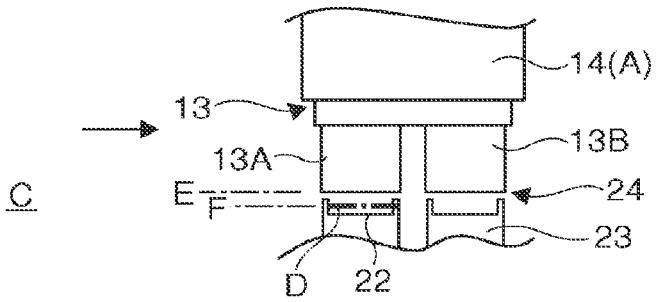

The third flushing control unit 35 then moves the carriage 14 from the home position A to the printing area C side. As shown in FIG. 9C, the carriage 14 is then stopped at a position where the second inkjet head 13B is opposite the vacuum head cap 22, and the second inkjet head 13B is flushed (step ST13). When flushing is completed, the carriage 14 returns to the home position A as shown in FIG. 9D and the elapsed time is reset (step ST14). The inkjet printer 1 then waits to receive print data as shown in FIG. 9A.

Because the second inkjet head 13B is flushed by this flushing operation before the viscosity of ink in the second inkjet head 13B increases when the carriage is stopped at the home position A for a long time, the nozzles of the second inkjet head 13B are prevented from becoming clogged due to increased ink viscosity when print data is received.

An increase in the viscosity of ink in the inkjet head while the carriage 14 waits at the home position A is related to the time elapsed since the previous flushing operation and the concentration of moisture retention material in the ink sponge disposed in the head cap that seals the inkjet head. However, an ink sponge 25 is not disposed in the moisture retention head cap 23 that caps the second inkjet head 13B at the home position A. As a result, the only parameter that affects an increase in ink viscosity in the second inkjet head 13B is the time passed since the last flushing, and increased ink viscosity can be controlled by monitoring this time. Therefore, if the second inkjet head 13B is flushed based on this elapsed time, discharge problems caused by increased ink viscosity can be reliably prevented. There is therefore no need to flush the nozzles of the second inkjet head before printing the print data, ink discharge problems can be prevented in the ink nozzles of the second inkjet head 13B, and print quality will not drop.

Other Embodiments

The second flushing control unit 33 may be configured to flush the second inkjet head 13B while the second inkjet head 13B passes over the vacuum head cap 22. More specifically, the second inkjet head 13B is flushed while the second inkjet head 13B passes the position opposite the vacuum head cap 22 after printing the print data is completed. Because the carriage 14 returns without delay to the home position A in this configuration, starting to print the next print data is not delayed.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A flushing control method for an inkjet printer, the flushing control method comprising:

moving adjacently disposed first and second inkjet heads bidirectionally from a home area to a printing area, the home area being removed from the printing area, and printing on a recording medium in response to a print data command by passing the first and second inkjet heads through the printing area and ejecting ink from at least one of the first and second inkjet heads onto the recording medium, and, after printing in response to the print data command has ended, moving the first and second inkjet heads to a flushing position in which the first inkjet head is on a printing area side of a flushing head cap containing an ink sponge and the second inkjet head is opposite the flushing head cap, the flushing head cap being disposed within the home area, and then moving the first and second inkjet heads to the home area, wherein the first inkjet head is flushed at the home area before the first and second inkjet heads move from the home area to the printing area when printing starts in response to the print data command; and wherein the second inkjet head is flushed at the flushing position when the first and second inkjet heads move from the printing area, back towards the home area, after the printing ends.

2. The flushing control method for an inkjet printer described in claim 1, wherein:

flushing the second inkjet head is done when the second inkjet head is temporarily stopped.

3. The flushing control method for an inkjet printer described in claim 1, wherein:

flushing the second inkjet head is done while moving the second inkjet head.

4. The flushing control method for an inkjet printer described in claim 1, further comprising steps of:

capping the second inkjet head with a moisture retention head cap, counting the time elapsed since the last flushing of the second inkjet head, and determining if the elapsed time has reached a predetermined reference time while the first and second inkjet heads are stopped at the home area; and when the elapsed time reaches the reference time, moving the first and second inkjet heads from the home area toward the printing area, stopping the second inkjet head at the flushing position, and then flushing the second inkjet head.

5. The flushing control method for an inkjet printer described in claim 1, wherein the moisture retention head cap is devoid of a component configured to remove ink from an inkjet head, and the moisture retention cap is adjacent to the flushing head cap and more distal from the printing area than the flushing head cap.

6. The flushing control method for an inkjet printer described in claim 1, wherein the home area is such that the first and second inkjet heads are removed from the printing area with the first inkjet head being opposite the flushing head cap and the second inkjet head being opposite the moisture retention head cap.

7. The flushing control method for an inkjet printer described in claim 1, wherein:

flushing the second inkjet head only occurs at a separate time from flushing the first inkjet head.

8. The flushing control method for an inkjet printer described in claim 1, further comprising:

printing in the printing area after flushing the first inkjet head at the home area and before flushing the second inkjet head at the flushing position.

9. The flushing control method for an inkjet printer described in claim 1, further comprising:

returning the first and second inkjet heads to the home area after flushing the second inkjet head at the flushing position and before subsequently moving the first and second inkjet heads to the printing area.

10. The flushing control method for an inkjet printer described in claim 1, further comprising:

returning the first and second inkjet heads to the home area after each time the step of flushing the second inkjet head at the flushing position is performed.

11. The flushing control method for an inkjet printer described in claim 1, wherein the step of flushing the first inkjet head is independent of a time at which the first inkjet head was previously flushed.

12. The flushing control method for an inkjet printer described in claim 11, wherein the step of flushing the second inkjet head is independent of a time at which the second inkjet head was previously flushed.

13. The flushing control method for an inkjet printer described in claim 1, wherein when the step of flushing the first inkjet head at the home area occurs, the second inkjet head is not flushed while in the home area, and wherein when the step of flushing the second inkjet head at the flushing position occurs, the first inkjet head is not flushed while in the flushing position.

* * * * *